United States Patent [19]

Hess

[11] Patent Number: 4,517,816

[45] Date of Patent: May 21, 1985

[54] EARRING FASTENER

[76] Inventor: Herman A. Hess, 10 Eddystone Ave., Downsview, Ontario, Canada, M3H 1H4

[21] Appl. No.: 555,300

[22] Filed: Nov. 28, 1983

[51] Int. Cl.[3] ..... A44C 7/00; A44B 9/00

[52] U.S. Cl. ..... 63/12; 24/155 R

[58] Field of Search ..... 24/155 R, 155 BB, 155 SD, 24/132 WL, 328, 333, 337, 517, 544, 662; 63/12, 13

[56] References Cited

U.S. PATENT DOCUMENTS

| | | | |
|---|---|---|---|
| 364,140 | 5/1887 | Smitten | 63/12 |
| 501,184 | 7/1893 | du Bus | 24/155 R |
| 681,313 | 8/1901 | Hammond | 24/544 X |
| 1,046,282 | 12/1912 | Dusetzina | 24/155 R |
| 1,093,765 | 4/1914 | Burns | 24/155 R |
| 1,274,006 | 7/1918 | Clarke et al. | 24/517 |
| 2,136,802 | 11/1938 | Moser | 24/337 |
| 4,184,343 | 1/1980 | Green | 63/12 |

FOREIGN PATENT DOCUMENTS

| | | | |
|---|---|---|---|
| 373152 | 4/1923 | Fed. Rep. of Germany | 24/517 |

*Primary Examiner*—F. Barry Shay

*Attorney, Agent, or Firm*—Sim & McBurney

[57] ABSTRACT

A fastener for the stud of an ornament for pierced ears includes a gripping member and a latch. The gripping member has a base portion, an aperture means in the base portion through which a stud can pass, and two resilient arms. The first resilient arm is affixed to the base portion such that it can flex to move toward the stud when the latter is positioned through said aperture, and the second resilient arm is also affixed to the base in opposed relation to the first arm, so that it can flex and move toward the first arm. The arms can contact a stud on opposite sides thereof and squeeze it, and the squeezing force is enhanced and secured by a latch which is pivotally connected to the first arm and is adapted to engage the second arm, in order to draw the two arms toward each other, thus squeezing a stud positioned between them.

8 Claims, 6 Drawing Figures

EARRING FASTENER

This invention relates generally to earrings, and pertains particularly to a fastener for the stud of an ornament for pierced ears.

BACKGROUND OF THIS INVENTION

The most commonly utilized fastener for earrings intended for pierced ears is that known as a "butterfly", which will be described in greater detail with respect to FIG. 1 at a later point in this disclosure. Basically, however, the butterfly of conventional use is simply a scrolled band of metal with a hole in the centre for passage of the stud, and the two ends coiled inwardly to rest resiliently against opposite sides of the stud, thereby retaining the butterfly in position on the stud. In use, the stud is passed through the pierced aperture in the earlobe from the outside, and the butterfly is snapped on the inwardly projecting end of the stud from behind the lobe.

Through repeated use, the butterfly is known to lose its ability to grip the stud securely, either because of wear, or distortion, or both. Many earrings of this type can be extremely expensive, and therefore it is desirable to provide some form of fastener for such studs which will be more reliable than the butterfly fasteners commonly in use.

Prior art of interest is also found in the area of hat pin protecting devices, such as were commonly used at the beginning of the twentieth century. The following may particularly be noted:

U.S. Pat. No. 1,089,867, Przybytka, Mar. 10, 1914

U.S. Pat. No. 1,148,211, Carreras, July 27, 1915

U.S. Pat. No. 1,024,563, Eckhart, Apr. 30, 1912

U.S. Pat. No. 942,517, Reynolds, Dec. 7, 1909.

The Eckhart and Carreras devices use simple resilient squeezing to secure the fastener on the end of the hat pin, while Przybytka utilizes a camming device with an activating lever. Reynolds utilizes a bent piece of metal which, when resiliently distorted, has a plurality of holes which are in alignment and allow a hat pin to be inserted. When the device is released from its deformed condition, the holes seek to go out of alignment, thus gripping the pin.

Of lesser interest in U.S. Pat. No. 4,372,131, Musillo, Feb. 8, 1983, which discloses a spring-biased latch member for engagement with the end of a stud passing through the pierced aperture in an earlobe.

The hat pin fastener devices disclosed in the patents above listed are all too cumbersome, large and heavy to be utilized as a fastener for the stud of an ornament for pierced ears. Naturally, any appropriate device must be small enough to be hidden by the earlobe, an in this sense none of the hat pin devices would do.

The Musillo device requires a spring member, which of course introduces unreliability since the spring could break or lose its resilience, and since the spring constitutes a fourth independent member of the entire combination (the more members, the less reliable the device). In any event, Musillo is directed to a true "ring" for the ear, which is such as to support the pivoted end of the stud at one terminus of the ring, and the spring-biased latch at the other terminus of the ring.

By contrast, the present invention seeks to provide a reliable fastener for strongly gripping the stud of an ornament for pierced ears, where there is no ring member looping around from the back to the front of the earlobe (as in Musillo). Moreover, the present invention seeks to maximize reliability by minimizing the total number of pieces, reducing these to two in number.

GENERAL DESCRIPTION OF THIS INVENTION

Accordingly, this invention provides a fastener for the stud of an ornament for pierced ears, the fastener having a gripping member and a latch. The gripping member includes a base portion, aperture means in the base portion through which a stud can pass, and a first resilient arm affixed to the base portion such that it can flex to move toward a stud when positioned to extend through the aperture means. The gripping member further includes a second resilient arm affixed to the base in opposed relation to the first arm such that it can flex and move toward the first arm, whereby the arms can contact a stud on opposite sides thereof and squeeze the same. The latch is pivotally connected to the first arm and is adapted to engage the second arm to draw the two arms toward each other, thus squeezing a stud positioned between them. The gripping member is formed from a band of resilient metal which is bent to define a substantially flat central region constituting the base portion. The aperture means is a hole substantially centrally of the flat central region, and the central region has opposed ends remote from the hole. The first arm is an integral part of the band of metal and extends from one of the ends toward the hole, then undergoes a bend to extend away from the flat central region, to terminate in a hinged connection with the latch.

The second arm is also integral with the band of metal, and extends from the other of the ends toward the hole, then undergoes a bent to extend away from the flat central region while defining an indent engageable by the latch.

GENERAL DESCRIPTION OF THE DRAWINGS

One embodiment of this invention is illustrated in the accompanying drawings, in which like numerals denote like parts throughout the several views, and in which.

DETAILED DESCRIPTION OF THE DRAWINGS

Figure 1:
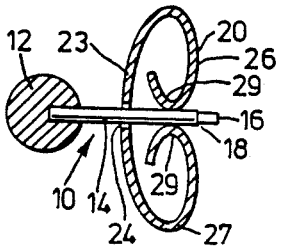
FIG. 1 (PRIOR ART)
FIG. 1 is an axial sectional view of a prior art device.

Attention is first directed to FIG. 1, which shows a prior art ornament 10 for pierced ears, the ornament including a ball 12 (which of course could be any attractive ornament such as a pearl, stone, etc.), and a stud 14 projecting radially from and embedded in the ball 12. The stud 14 has a rounded forward end 16 and a reduced collar 18, in accordance with conventional practice.

The conventional fastener shown in FIG. 1 is what is known as a "butterfly", and is shown at 20 in FIG. 1. The butterfly is basically a scrolled strip or band of resilient metal which includes a middle region 23 having an aperture 24 for the passage of the stud 14, and two reverse-scrolled ends 26 and 27, each having a portion 29 adapted resiliently to bear against the stud 14, the two portions 29 bearing from opposite sides, so as to squeeze the stud 14 and retain the butterfly 20 in any given position.

As previously stated, the butterfly 20 shown in FIG. 1 suffers from the important disadvantage that it risks losing its resiliency and/or becoming worn, to such an extent that it no longer adequately grips the stud 14. This may result in loss of the ornament. Where precious stones or expensive pearls etc. are used as the ornament, it is evident that unreliable fasteners like the butterfly 20 could advantageously be replaced with something more reliable.

Figure 2:
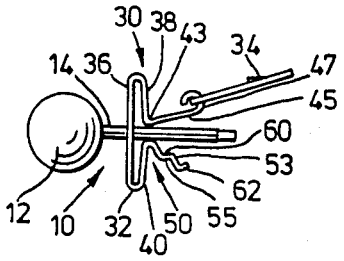
FIG. 2 is an elevational view of a device constructed in accordance with this invention.

The fastener proposed by the present invention is illustrated in the remaining figures, and attention is directed to FIG. 2 which shows the same ornament 10 including the ball 12 and stud 14. The fastener is shown at 30, and generally includs a gripping member 32 and a latch 34. The gripping member includes a base portion 36 having an aperture (not visible in the figure) through which the stud 14 can pass, a first resilient arm 38, and a second resilient arm 40. The first resilient arm is integral with the base portion 36 and thus is affixed thereto in a resilient way. More particularly, the first resilient arm 38 undergoes a reverse bend and extends toward the stud 14 substantially parallel to but slightly spaced from the base portion 36, then undergoing a bend of approximately 90° at 43 to extend generally away from the base portion 36 as a lever member 45, the latter terminating in a hinge knuckle 47 where the latch 34 is pivotally connected.

The second resilient arm is also integrally connected with the base portion 36 and extends from an opposite edge of the base portion 36 toward the aperture through which the stud 14 passes, then undergoing a bend at 50 to extend away from the base portion 36. The part just mentioned which extends away from the base portion 36 defines an indent 53 which is engageable by the latch 34. More specifically, the part of the second resilient arm 40 which extends away from the base portion 36 is identified generally by the numeral 55, and is seen to incorporate an obliquely downwardly and rightwardly extending portion 57 (seen in FIG. 3), which adjoins an inverted V-shaped portion 60 defining the indent 53, which adjoins a cam surface 62 constituting a lead-in for the latch 34.

Figure 3:
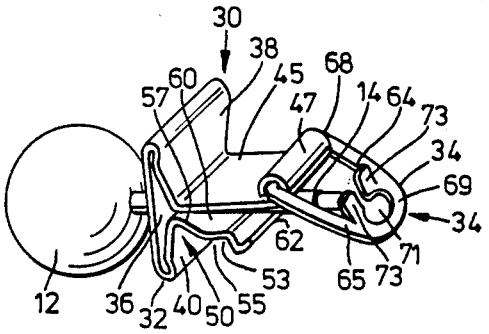
FIG. 3 is a perspective view of the device shown in FIG. 2.
Figure 4:
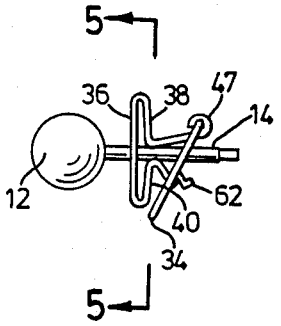
FIG. 4 is an elevational view similar to FIG. 2, showing the latch in engaged position.

Looking at FIG. 3, the latch 34 is preferably stamped from a sheet of appropriate metal, and is in the shape of an integral frame having two side members 64 and 65, there being joined at the leftward end (as seen in FIG. 3) by a connecting member 68 (mostly hidden by the hinge knuckle 47), and joined at the rightward end (as pictured in FIG. 3) by a rounded bridge member 69 defining the lower periphery of an opening 71 which in turn adjoins two obliquely extending tabs 73 which are spaced apart on either side of a mid-line of the latch 34. It is intended that the upper ends of the tabs 73 should slide in over the lead-in cam surface 62 and lodge within the inverted V-shaped indent 53 of the rightwardly extending part of the second resilient arm 40, as shown in FIG. 4. The roundedness of the transition between the lead-in cam surface 62 and the indent 53 allows the latch to be moved into and out of engagement quite easily, although once in engagement the latch 34 will not easily be shaken loose.

As can be seen by comparing FIGS. 2 and 4, the rightwardly extending part 55 of the second resilient arm 40 has been pulled up by engagement with the latch in FIG. 4, as compared to FIG. 2. This means that the rightward extending parts of the first and second resilient arms 38 and 40 respectively have effectively been pulled toward each other by the latch 34 when it engages the indent 53. The geometry of the fastener is such that, in the condition of FIG. 2, the stud 14 can easily be inserted between the resilient arms and withdrawn therefrom, without undue force being exerted.

However, in the condition of FIG. 4, in which the resilient arms have their rightwardly extending parts drawn toward each other by the latch 34, a considerable additional squeezing pressure or force is applied on either side of the stud 14, and this additional force makes it particularly difficult to withdraw the stud 14 from engagement with the arms.

Figure 5:
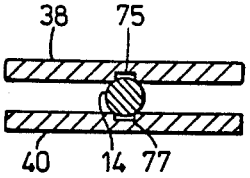
FIG. 5 is a cross-sectional view taken at the line 5—5 in FIG. 4.

Attention is directed to FIG. 5, which shows a cross-sectional view through the contact location between the arms 38, 40 and the stud 14. It will be seen that each of the arms 38, 40 has a square-shaped groove 75, 77 respectively, and that the width of each groove is less than the diameter of the stud 14, whereby the square corners at the upper edges of the grooves 75, 77 in effect "bite" into the stud 14 and help to improve the grip.

Figure 6:
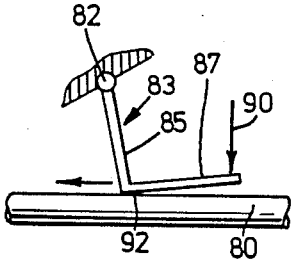
FIG. 6 is a schematic view of a mechanism simulating a portion of the fastener shown in the figures, and illustrating the squeezing effect applied.

Attention is now directed to FIG. 6, which illustrates the way in which a particularly strong gripping force is applied to the stud by the fastener herein disclosed.

In FIG. 6, the shaft 80 represents the stud 14. A pivot point 82 is fixed with respect to the stud in the scheme of FIG. 6, and a bent arm 83 having an upper portion 85 and a lower portion 87 is pivoted at the pivot 82. The upper portion 85 is just long enough that, when it is at right angles to the shaft 80, it is in mechanical interference therewith. The lower portion 87 extends approximately perpendicularly to the upper portion 83, and in this model is assumed to be rigid with respect thereto. Thus the entire arm 83, including both portions 85 and 87 swings as a unit.

It will now be seen that downward pressure along the arrow 90 at the rightward end of the lower arm portion 87 will cause clockwise pivoting of the arm 83 above the pivot point 82, thus strongly urging the "elbow" 92 into mechanically interfering contact with the shaft 80. It will also be realized that, due to the fact that the upper arm portion 85 contacts the shaft 80 only when it is nearly perpendicular thereto, a considerable mechanical advantage is attained by this structure.

It will be evident that the arrangement of the gripping member 30 shown in the figures is such as to simulate the idealized mechanical relationship shown in FIG. 6, and that an appropriate sizing of the resilient arms 38 and 40 will allow these to place a very strong squeezing force on the stud 14, thus securely retaining the fastener 30 in position on the stud 14.

While one embodiment of this invention has been illustrated in the accompanying drawings and described hereinabove, it will evident to those skilled in the art that changes and modifications may be made therein, without departing from the essence of this invention as set forth in the appended claims.

What I claim is:

1. A fastener for the stud of an ornament for pierced ears, the fastener having a gripping member and a latch, (a) the gripping member comprising:

a base portion, aperture means in the base portion through which a stud can pass, a first resilient arm affixed to said base portion such that it can flex to move toward a stud when positioned to extend through said aperture means, a second resilient arm affixed to said base in opposed relation to said first arm such that it can flex and move toward said first arm, whereby the arms can contact a stud on opposite sides thereof and squeeze the same, (b) the latch being pivotally connected to said first arm and adapted to engage said second arm to draw the two arms toward each other, thus squeezing a stud positioned therebetween, (c) the gripping member being formed from a band of resilient metal which is bent to define a substantially flat central region constituting said base portion, the aperture means being a hole substantially centrally of said flat central region, the central region having opposed ends remote from said hole, the first arm being an integral part of said band of metal and extending from one of said ends toward the hole, then undergoing a bend to extend away from the flat central region, and terminating in a hinged connected with said latch, the second arm being also an integral part of said band of metal and extending from the other of said ends toward the hole, then undergoing a bend to extend away from the flat central region while defining an indent engageable by said latch.

2. The fastener claimed in claim 1 in which the two arms have square-cut channels where they are adapted to contact and squeeze a stud.

3. The combination of the connector claimed in claim 2 with an ear ornament incorporating a stud.

4. The fastener claimed in claim 1 in which the part of the second arm extending away from the flat central region has an undulating profile including a trough constituting said indent, and including a cam surface to lead in the latch.

5. The combination of the connector claimed in claim 4 with an ear ornament incorporating a stud.

6. The fastener claimed in claim 4, in which the latch has an oblique portion for engagement in said indent.

7. The combination of the connector claimed in claim 6 with an ear ornament incorporating a stud.

8. The combination of the connector claimed in claim 1 with an ear ornament incorporating a stud.

* * * * *